United States Patent [19]

Vilen

[11] 4,257,454

[45] Mar. 24, 1981

[54] DRAIN PLUGS

[75] Inventor: Erik O. Vilen, La Grange Park, Ill.

[73] Assignee: G. S. Blakeslee & Company, Chicago, Ill.

[21] Appl. No.: 966,073

[22] Filed: Dec. 4, 1978

[51] Int. Cl.[3] ..... E03B 9/00; F17D 1/13

[52] U.S. Cl. ..... 137/593; 137/577

[58] Field of Search ..... 137/577, 593; 4/206, 4/256, 255, 201; 285/231, 235

[56] References Cited

U.S. PATENT DOCUMENTS

| | | | |
|---|---|---|---|
| 401,579 | 4/1889 | Newell | 4/201 |
| 740,737 | 10/1903 | Blum | 4/206 |
| 2,016,498 | 10/1935 | Hopewell | 4/256 |
| 2,027,661 | 1/1936 | Woodward | 4/256 |
| 2,263,963 | 11/1941 | Barry | 137/577 |
| 2,626,405 | 1/1953 | Keith | 4/256 |
| 3,108,607 | 10/1963 | Blakeslee | 134/186 |
| 3,934,280 | 1/1976 | Tancredi | 4/255 |
| 4,077,430 | 3/1978 | Brown | 137/577 |

FOREIGN PATENT DOCUMENTS

| | | | |
|---|---|---|---|
| 1031169 | 1/1924 | Switzerland | 4/256 |
| 686198 | 1/1953 | United Kingdom | 137/593 |

*Primary Examiner*—Gerald Goldberg
*Assistant Examiner*—Denis E. Corr
*Attorney, Agent, or Firm*—Emrich, Root, Lee, Brown & Hill

[57] ABSTRACT

A drain plug of the standpipe type embodying an elongated tubular member for affording drainage when the liquid level in a compartment is at the top of the standpipe, and a resilient, annular valve member mounted on the lower end portion of the standpipe for sealingly engaging a valve seat in a drain opening for preventing flow of said liquid into said drain opening around said standpipe, the valve member having an upper and lower flanged construction that is effective to guard against leakage around and damage to the drain plug if the drain plug is improperly aligned or excessive closing pressures are applied thereto.

10 Claims, 8 Drawing Figures

DRAIN PLUGS

BACKGROUND OF THE INVENTION

The present invention relates to drain plugs, and, more particularly, to drain plugs of the standpipe type.

A primary object of the present invention is to afford a novel drain plug.

Another object of the present invention is to afford a novel drain plug of the standpipe type.

Drain plugs of the standpipe type have been heretofore known in the art, being shown, for example, in U.S. Pat. Nos. 3,108,607, issued Oct. 29, 1963 to D. G. Blakeslee; 401,579, issued Apr. 16, 1889 to W. H. Newell and 2,263,963, issued Nov. 25, 1941 to E. G. H. Barry. It is an important object of the present invention to afford improvements over drain plugs of the standpipe type heretofore known in the art.

Drain plugs of the standpipe type heretofore known in the art commonly have had several inherent disadvantages, such as, for example, being difficult to install because, among other things, of the accuracy required in the effective installation thereof; being unreliable in operation; being readily damaged because of misalignment or excessive closing pressures, and the like; or being difficult and expensive to manufacture, and the like. It is another important object of the present invention to overcome such disadvantages.

Another object of the present invention is to afford a novel drain plug of the standpipe type, which embodies a novel resilient member, constituted and arranged in a novel and expeditious manner, for controlling closing and opening of a drain around the drain plug.

Yet another object of the present invention is to afford a novel drain plug of the standpipe type, which is operable in a novel and expeditious manner to effect closing of a drain opening.

A further object of the present invention is to afford a novel drain plug of the standpipe type which is operable in a novel and expeditious manner to compensate for misalignment of the drain plug.

Another object of the present invention is to afford a novel drain plug of the standpipe type which is operable in a novel and expeditious manner to compensate for excessive closing pressures applied thereto, whether those pressures are applied to the entire plug or to one side or portion thereof.

Another object of the present invention is to afford a novel drain plug of the standpipe type which is practical and efficient in operation and which may be readily and economically produced commercially.

Other and further objects of the present invention will be apparent from the following description and claims and are illustrated in the accompanying drawings, which, by way of illustration, show the preferred embodiment of the present invention and the principles thereof and what I now consider to be the best mode in which I have comtemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 3:
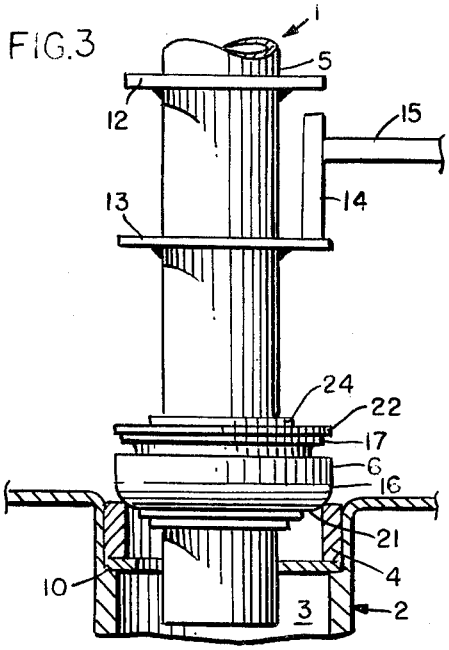
FIG. 3 is an elevational view, similar to FIG. 2, but showing the drain plug in excessively closed position.
Figure 3:
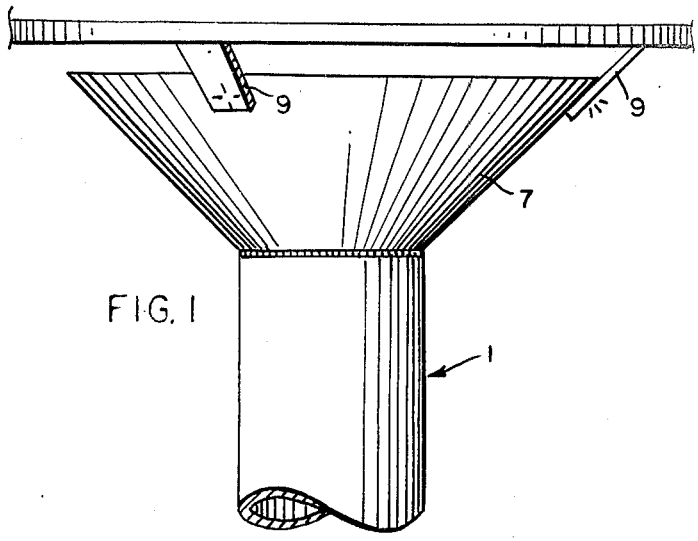

A drain plug 1, embodying the principles of the present invention, is shown in the drawings to illustrate the presently preferred embodiment of the present invention. The drain plug 1 is shown mounted in a drain 2, having a drain opening 3 therethrough, with a valve seat 4 mounted in the drain opening 3, FIGS. 1–3.

The drain plug 1, shown in the drawings, embodies an elongated drain tube or standpipe 5, which is open throughout its length; a resilient, annular valve member 6 mounted on the lower end portion of the standpipe 5 and movable therewith into and out of engagement with the valve seat 4, as will be discussed in greater detail presently; and a drain cup 7 mounted on the upper end portion of the standpipe 5.

The drain plug 1 also embodies a cover member 8 extending across the top of the drain cup 7 in upwardly spaced relation thereto, and secured thereto by suitable means such as mounting brackets 9, welded to the drain cup 7 and the cover 8, Fig. 1, for a purpose which will be discussed in greater detail presently.

Figure 4:
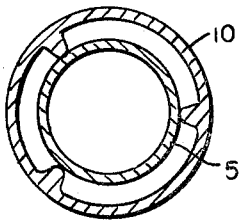
FIG. 4 is a detail sectional view taken substantially along the line 4—4 in Fig. 1.

The drain plug 1 is adapted to be used in any suitable device or apparatus, such as, for example, a dish washing machine of the type disclosed in the aforementioned Blakeslee Patent No. 3,108,607, wherein it is desired to control the flow through and the level of liquid in the device or apparatus. In such use of the drain plug 1, it is slidably mounted in suitable supporting members, such as a guide ring 10, mounted in the drain 2, FIGS. 1 and 4, and another guide member, not shown, such as, for example, a suitable upper guide bracket, as shown in the aforementioned Blakeslee U.S. Pat. No. 3,108,607.

Figure 1:
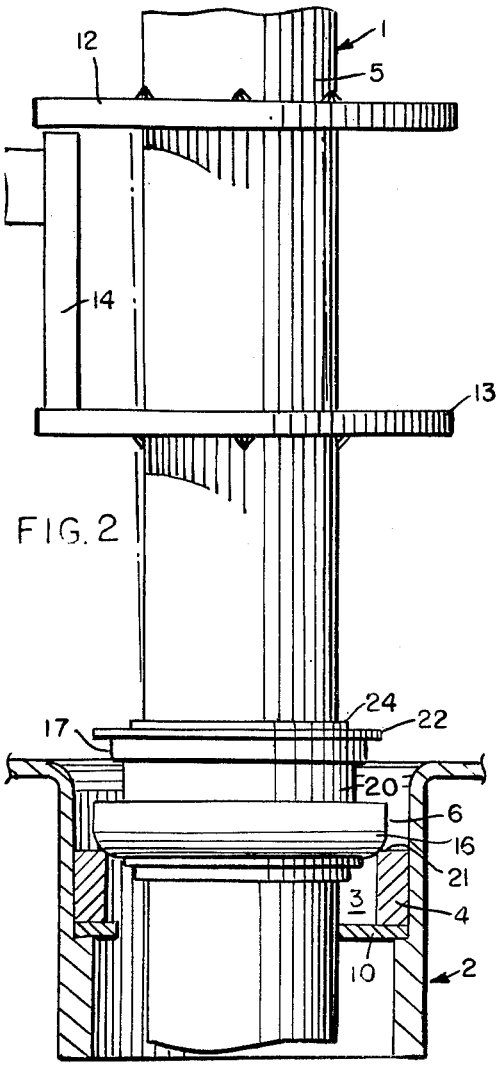
FIG. 1 is a broken, elevational view of a drain plug embodying the principles of the present invention, showing the drain plug in an open position relative to a drain opening.
Figure 2:
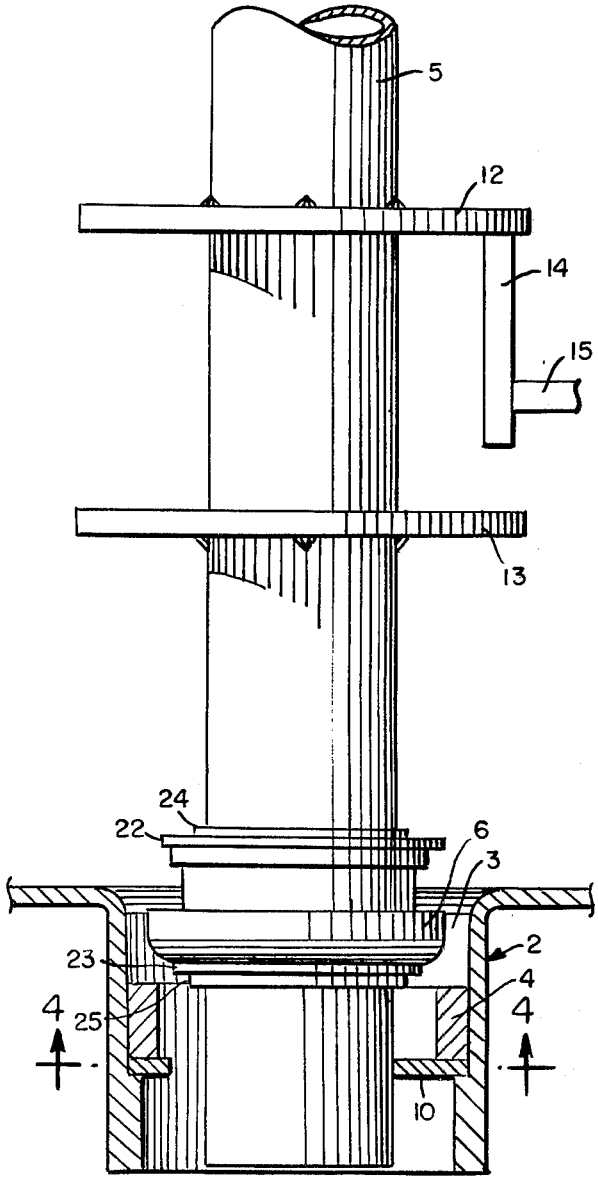
FIG. 2 is a fragmentary elevational view of a portion of the drain plug shown in FIG. 1, showing the drain plug in a closed position.

Two cam rings 12 and 13 are disposed around and secured to the standpipe 5 by suitable means, such as welding, and are disposed in spaced relation to each other longitudinally of the standpipe 5, FIGS. 1–3. The cam rings 12 and 13 are adapted to be engaged by a suitable raising and lowering member or mechanism, such as a cam 14, FIGS. 1–3, which is secured to a shaft 15 in the apparatus or device, not shown, with the cam 14 being rotatable, by rotation of the shaft 15, between an upper position, as shown in FIG. 1, wherein it is effective to engage the lower surface of the cam ring 12 and thereby raise the drain plug 1 relative to the valve seat 4, and a lowered position, as shown in FIG. 2, wherein it is effective to engage the upper surface of the cam ring 13 and thereby press the valve member 6 down into seating engagement with the valve seat 4.

When the drain plug 1 is being used in its intended manner, it is mounted in a compartment of a device or apparatus, such as the aforementioned dish washing machine shown in the Blakeslee Patent No. 3,108,607, in position wherein, when the drain plug 1 is disposed in the lowered position shown in FIG. 2, it is effective to prevent the passage of liquid from the compartment downwardly through a drain, such as the drain 2, around the drain plug 1. With the drain plug 1 so positioned in the compartment, the latter may be filled with liquid to the level of the top of the drain cup 7. With the compartment filled to such a level, any additional liquid flowing into the compartment will pass down through the drain cup 7 and standpipe 5 into the drain 2, from which it may flow to any suitable receiver, such as, for example, a sewer, not shown. When it is desired to empty the liquid from the aforementioned compartment, the drain plug 1 may be raised upwardly into a position, such as that shown in FIG. 1, wherein the valve member 6 is disposed in upwardly spaced relation to the valve seat 4 to thereby permit the liquid to flow downwardly through the drain opening 3 of the drain 2, between the drain plug 1 and the valve seat 4.

Figure 6:
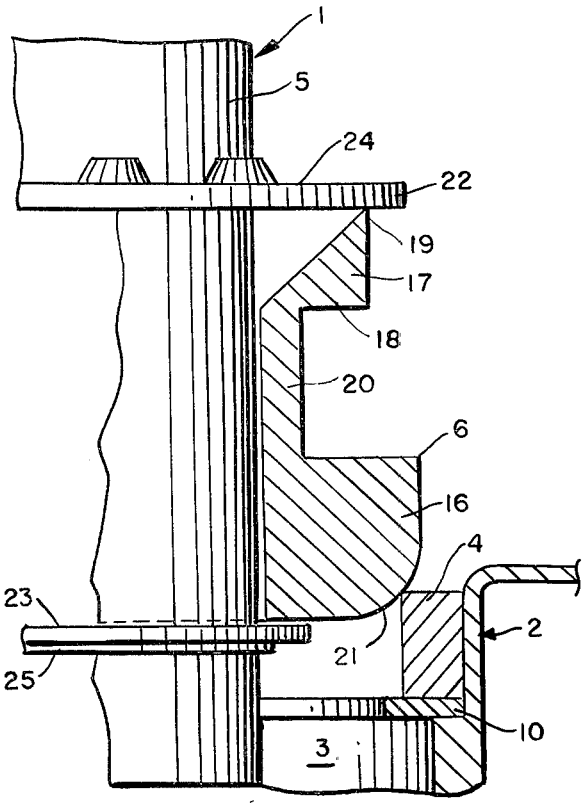
FIG. 6 is an enlarged, detail sectional view of a portion of the drain plug as shown in FIG. 2.

The valve member 6 may be made of any suitable, resilient material, such as, for example, rubber. As may be seen in FIG. 6, it embodies a large, and, in fact, relatively massive, lower end portion 16, having a substantial thickness in both vertical and horizontal direction; a smaller, substantially wedge-shaped upper end portion 17, which tapers upwardly and outwardly from a base 18 to a relatively thin or narrow, annular upper end portion 19; and an intermediate portion 20, which is substantially cylindrical in shape and has a wall thickness that is substantially less than that of both the lower end portion 16 and the upper end portion 17. I prefer that the thickness of the lower end portion 16 be substantially the same in both the vertical and horizontal direction, and that these thicknesses be substantially greater than the corresponding thicknesses of the upper end portion 17, and, preferably, be substantially one and one-half times those thicknesses; and that the thickness of the intermediate portion 20 be substantially less than the horizontal thickness of the upper end portion 17, and, preferably, be in the nature of one third of the latter thickness. Also, for sealing purposes, as will be discussed in greater detail hereinafter, I prefer that the upper portion 19 of the upper end portion 17 of the valve member 6 constitutes substantially a sharp edge; and that the outer lower surface 21 of the lower end portion 16 of the valve member 6 be in the form of a convex-outwardly rounded arc.

In the drain plug 1, the valve member 6 is disposed around the standpipe 5 between an upper retaining washer 22 and a lower retaining washer 23 preferably mounted on the standpipe 5 with a relatively loose fit, with retaining rings 24 and 25 disposed above and below the washers 22 and 23, respectively, and secured to the standpipe 5 by suitable means, such as, for example, welding, in position to hold the retaining washers 22 and 23 in loosely fitting, closely adjacent relation to the valve member 6. Preferably, the valve member 6 is mounted on the standpipe 5 with a relatively snug, sliding fit. Also, in the preferred form of the drain plug 1, as shown in FIG. 1, the retaining washers 22 and 23 and the retaining rings 24 and 25 are disposed on the standpipe 5 in perpendicular relation to the length thereof, so as to afford flat uniform supporting engagement with the valve member 6 completely around the upper and lower surfaces thereof. However, as will be discussed in greater detail hereinafter, the construction of my novel drain plug 1 is such that, even if, because of faulty assembly of the retainer ring 24 and 25 on the standpipe 5, the retaining washer 22 or 23 is not disposed in truely perpendicular relation to the standpipe 5, the drain plug 1 still will afford effective sealing engagement with the valve seat 4 in closed relation thereto.

Figure 7:
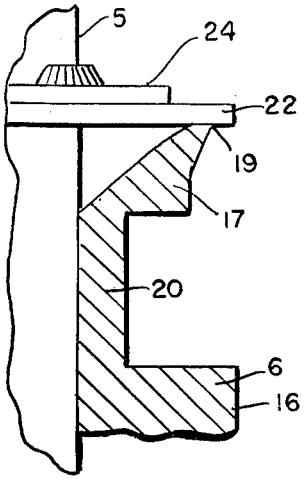
FIGS. 7 and 8 are detail sectional views, similar to FIG. 6, but showing the drain plug in different, respective operative positions.

In the normal construction and operation of the drain plug 1, the parts thereof are so constituted and arranged that when the drain plug 1 is disposed in raised or "open" position, the valve member 6 is disposed in upwardly spaced relation to the valve seat 4, as shown in FIG. 1; and when the drain plug 1 is disposed in lowered or "closed" position the arcuate surface 21 of the lower end portion 16 of the valve member 6 is disposed in engagement with the inner upper edge portion of the valve seat 4, throughout its periphery, and is relatively lightly, but firmly held in such engagement with the valve seat 4 by the pressure applied by the retaining washer 22 to the upper extremity 19 of the upper end portion 17 of the valve member 6, this pressure being of sufficient magnitude as to cause the upper extremity 19 of the upper end portion 17 to flex outwardly somewhat, as shown in FIG. 7, and to engage the lower face of the upper retaining washer 22 in good sealing relationship therewith.

Figure 8:
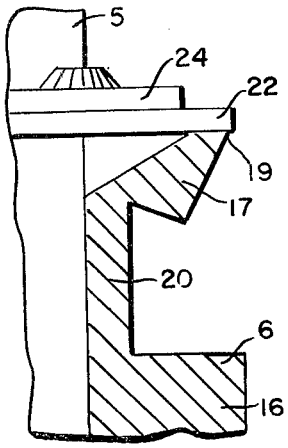

However, in addition, the construction and operation of the drain plug 1 is such that, even under abnormal operating conditions, it will operate effectively and without damaging stress being placed on it or on the parts with which it cooperates. Thus, for example, if for some unintended reason, such as, for example, erroneously securing the cam ring 13 on the standpipe 5 at too high a position, so that in the "closing" operation of the cam 14, the standpipe 5 is pressed downwardly a greater distance than was intended, the valve member 6 will not be pressed against the valve seat 4 with a dangerous force, as is true with respect to drain plugs heretofore known in the art, which are of the general nature of the drain plug 1 but wherein the valve member thereof was of an unyielding or relatively unyielding nature. Instead, in such operation of the drain plug 1, the relatively thin upper portion of the upper end portion 17 of the valve member 6 will be compressed, in and of itself, and if the downward movement of the standpipe 5 is sufficiently excessive, the upper end portion 17 will be deflected downwardly and outwardly around its connection with the intermediate portion 20 of the valve member 6, as shown in FIG. 8, so as to lessen the force with which the valve member 7 would otherwise be pressed against the valve seat 4, the entire upper end portion 17 of the valve member 6 moving downwardly, during such operation, relative to the lower end portion 16 thereof, as shown in FIG. 3.

Figure 5:
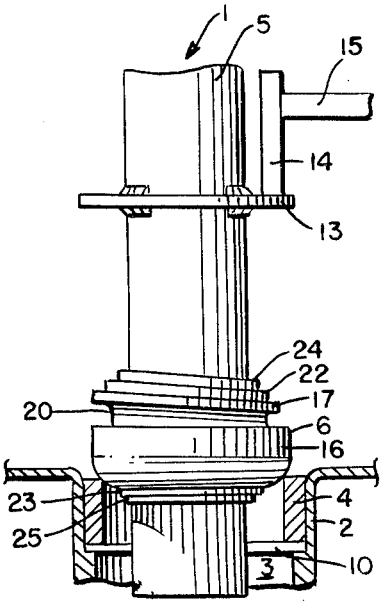
FIG. 5 is a fragmentary elevational view, similar to FIGS. 2 and 3, but showing upper plug retainer member drain plug improperly fastened to the standpipe.

Also, if the seating force applied to the valve member 6 is not equally distributed therearound, but is greater on one side of the valve member 6 than on the opposite side thereof, the construction of my novel drain plug 1 is such that effective seating of the valve member 6 with the valve seat 4 will still be effected, as illustrated in FIG. 5. Such uneven force may be applied to the valve member 6 for various reasons, such as, for example, because of misalignment of the standpipe 5 in the drain 2, or, as illustrated in FIG. 5, because of the accidental improper mounting of the retaining ring 24 on the standpipe 5, wherein one side, such as, for example, the right side, as viewed in FIG. 5, is disposed on the standpipe 5 at a lower position than the opposite side thereof. Under such conditions, what might otherwise be an excessive force applied to the lower end portion 16 of the valve member 6, in order to effect sealing engagement thereof with the entire upper, inner periphery of the valve seat 4, is absorbed in the upper end portion 17 and the connection thereof to the intermediate portion 20 of the valve member 16, the upper end portion 17 being capable of being compressed and deflected downwardly a greater amount on the aforementioned one side than on the other, FIG. 5, to thereby absorb this greater downward movement of the one portion of the retaining ring 24, without transmitting excessive forces to the engagement of the lower end portion 16 of the valve member 6 with the valve seat 4.

As previously mentioned, the drain plug 1 shown in the drawings is of a type particularly well adapted for use in a dish washing machine, such as, for example, the machine shown in the aforementioned Blakeslee Patent No. 3,108,607, but this is merely by way of illustration of the preferred embodiment of the present invention, and not by way of limitation, and various changes may be made in the drain plug 1 without departing from the purview of the broader aspects of the present invention. For example, the cover 8 is embodied in the drain plug 1 to prevent entry of large articles, such as, for example, dish cloths, or the like, which might inadvertently be left in the dish washing machine into the standpipe 5. Such a cover, of course, is not necessary to the broader aspects of the present invention.

Also, if desired, the drain cup 7 could be eliminated from the drain plug 1, merely using the upper end portion of the standpipe 5 as the over-flow entrance into the drain plug 1, without departing from the broader aspects of the present invention.

From the foregoing it will be seen that the present invention affords a novel drain plug of the standpipe type, which overcomes disadvantages common to drain plugs of the same general type heretofore known in the art. For example, the plug provides leakproof closing of the drain despite some looseness between the outside diameter of the standpipe tubing and inside diameter of the plug. Additionally, the plug provides leakproof closing because when the plug is pressed down against the drain seat, the upper portion is also pressed against the upper retainer and the inside diameter of the plug is pushed against the pipe surface thereby closing any possible irregularities on the pipe surface. Accordingly, it will be seen that the present invention affords a novel drain plug of the standpipe type which is practical and efficient in operation and which may be readily and economically produced commercially.

Thus, while I have illustrated and described the preferred embodiment of my invention, it is to be understood that this is capable of variation and modification, and I therefore do not wish to be limited to the precise details set forth, but desire to avail myself of such changes and alterations as fall within the purview of the following claims.

I claim:

1. A drain plug for use with a device embodying a compartment for holding a supply of liquid, with the compartment having a drain opening in the bottom thereof, and with an annular valve seat disposed in said opening, and an annular guide means disposed in said opening below said annular valve seat, said drain plug comprising a. an elongated, open standpipe
  (1) adapted to be reciprocated downwardly and upwardly through such a valve seat into and out of such a drain,
  (2) having a substantially radially outwardly projecting member thereon, and
  (3) wherein said upper end provides drain cup means for said standpipe, and b. an annular, resilient member
  (1) mounted on said standpipe adjacent the end opposite said upper end
    (a) in surrounding relation thereto, and
    (b) below said outwardly projecting member, on said standpipe,
  (2) having a bottom lower face, and
  (3) disposed in such position on said standpipe that during said downward movement of said standpipe through said valve seat said end opposite said upper end is engageable with said annular guide means to align said standpipe in a vertical position and wherein said outwardly projecting member is effective to compress said resilient member against said valve seat with said lower face of said resilient member in abutting engagement with said valve seat, c. said resilient member comprising
  (1) a lower end portion defining said bottom lower face,
  (2) an upper end portion
    (a) spaced outwardly from said standpipe a greater distance than said lower end portion, and
    (b) having a radial thickness which is less than the radial thickness of said lower end portion.

2. A drain plug as defined in claim 1 wherein a. said resilient member includes an intermediate portion
  (1) disposed between said lower end portion and said upper end portion, and
  (2) having an outer peripheral surface that is spaced outwardly from the longitudinal axis of said standpipe less than the outer peripheral surface of said upper end portion.

3. A drain plug as defined in claim 2 wherein a. said upper end portion of said resilient member
  (1) has a lower base connected to said intermediate portion, and
  (2) has an inner peripheral surface that slopes upwardly and outwardly away from said base.

4. A drain plug as defined in claim 3 wherein a. said intermediate portion has a radial thickness that is less than the radial thickness of said base.

5. An elongated drain plug for use in a device embodying a compartment for receiving a supply of liquid therein, a drain in the bottom of said compartment, an annular valve seat in said drain and defining a drain opening, and means for supporting an elongated member for upward and downward reciprocation into and out of said valve seat, said drain plug comprising a. an elongated open standpipe adapted to be mounted in upright position in said means for supporting an elongated member for longitudinal reciprocation down into and up out of said valve seat, b. a flexible, resilient, annular valve member,
  (1) mounted on the lower end portion of said standpipe in surrounding relation thereto, and
  (2) having
    (a) an upper end portion, and (b) a lower end portion, and c. upper supporting means and lower supporting means mounted on said standpipe above and below said annular valve member, respectively, for holding and maintaining said valve member in operative position on said standpipe, d. said upper supporting means being disposed on said standpipe in position to engage said upper end portion of said valve member and press said lower end portion of the latter into engagement with said valve seat during said movement of said standpipe down into said annular valve seat to seal the same, and e. said lower supporting means being disposed on said standpipe in position to engage said lower end portion of said valve member and move said valve member upwardly away from said valve seat during said movement of said standpipe up and out of said valve seat.

6. An elongated drain plug as defined in claim 5 wherein a. said valve member includes an intermediate portion disposed between and connected to said upper and lower end portions of said valve member, and b. said intermediate portion has an upper end portion (1) the radial thickness of which is less than the radial thickness of said upper end portion of said valve member, and (2) operatively connected to the inner peripheral edge portion of said upper end portion of said valve member, and c. said upper end portion of said valve member is pivotable downwardly around said connection with said intermediate portion upon application of downward pressure on the top of said upper end portion of said valve member.

7. An elongated drain plug as defined in claim 6, and in which a. said upper end portion of said valve member is substantially wedge-shaped, having (1) a lower end that projects radially outwardly beyond said intermediate portion, (2) an upper end that is radially narrower than said last mentioned lower end, and (3) an inner side that slopes upwardly and outwardly from said intermediate portion to said upper end of said upper end portion of said valve member.

8. An elongated drain plug as defined in claim 7 wherein a. said lower end portion of said valve member (1) has a radial thickness that is greater than the radial thickness of said upper end portion of said valve member, and (2) projects radially outwardly beyond said upper end portion of said valve member.

9. An elongated drain plug as defined in claim 8 wherein a. said lower end portion of said valve member has a thickness longitudinally of said standpipe that is not substantially less than said radial thickness of said lower end portion of said valve member.

10. An elongated drain plug as defined in claim 9 wherein a. the lower outer peripheral surface of said lower end portion of said valve member is arcuately convex outward in transverse cross section.

* * * * *